United States Patent [19]

Baron

[11] Patent Number: 4,509,895

[45] Date of Patent: Apr. 9, 1985

[54] CROWD DRIVE ASSEMBLY FOR POWER SHOVELS

[75] Inventor: George B. Baron, Marion, Ohio

[73] Assignee: Dresser Industries, Inc., Dallas, Tex.

[21] Appl. No.: 950,003

[22] Filed: Oct. 6, 1978

[51] Int. Cl.[3] ..... E02F 3/62

[52] U.S. Cl. ..... 414/685; 37/103; 37/118 A; 254/344; 414/687

[58] Field of Search ..... 414/694, 695, 722, 723, 414/727, 692, 709, 714, 700, 685, 707, 719, 697, 732, 733, 743, 738, 487; 37/1, 103, 117.5, 116, 118, 118 A, 126, 137; 254/344

[56] References Cited

U.S. PATENT DOCUMENTS

| | | | |
|---|---|---|---|
| 1,453,559 | 5/1923 | Webb | 254/186 R |
| 3,279,632 | 10/1966 | Kramlich | 414/694 |
| 3,395,893 | 8/1968 | Kumpf | 254/186 R X |
| 3,961,713 | 6/1976 | Stine | 254/186 R X |
| 4,044,903 | 8/1977 | Baron | 414/694 |

FOREIGN PATENT DOCUMENTS

| | | | |
|---|---|---|---|
| 570719 | 5/1924 | France | 254/186 R |
| 196080 | 4/1923 | United Kingdom | 254/186 R |

*Primary Examiner*—Frank E. Werner

*Attorney, Agent, or Firm*—Lalos, Leeds, Keegan, Lett, Marsh, Bentzen & Kaye

[57] ABSTRACT

In a power shovel having a main support unit, a front end assembly operatively connected to the main support unit and a rope crowd system mounted on the main support unit and operatively connected to the front end assembly, a crowd drive assembly for the rope crowd system comprising a rope drum mounted on a support frame supported on the main support unit, a drive shaft journaled in the support frame adjacent the tangential point of the crowd rope wound on the rope drum, transversely spaced means disposed on the drive shaft for transmitting torque to the rope drum and an appropriate motor and gear arrangement supported on the main support unit for driving the drive shaft.

22 Claims, 3 Drawing Figures

CROWD DRIVE ASSEMBLY FOR POWER SHOVELS

This invention relates to power shovels and more particularly to a rope crowd system of a power shovel. The invention more specifically contemplates a novel crowd drive assembly for a rope crowd system of a power shovel.

In the prior art, rope crowd systems used on large, heavy-duty mining shovels of the type disclosed in U.S. Pat. Nos. 3,501,034 and 3,648,863, generally have consisted of a gantry mounted on the main frame of the machine, a drum mounted on the deck of the machine at the foot of the gantry, a motor-generator set mounted on the deck, drivingly connected to the drum through a heavy gear train arrangement, a mast pivotally connected to the deck of the machine forwardly of the gantry, having pendants mounted on the upper end thereof, connected to the front end assembly of the machine, a sheave mounted on the upper end of the gantry, a sheave mounted on the upper end of the mast and a rope wound on the drum, passing upwardly to the sheave mounted on the upper end of the gantry, reeved about the sheaves mounted on the upper ends of the gantry and mast and dead-ended on the mast. While such systems have operated satisfactorily over the years, they have several disadvantages including the congestion caused on the main deck of the machine due to the space required on the deck by the hoist drum, motor-generator sets and transmission gearing of the system.

More recently, as disclosed in U.S. Pat. No. 4,044,903, it has been found that the aforementioned disadvantage of conventional rope crowd systems could be eliminated by relocating the crowd drive machinery of such a system to the head of the gantry. The relocation of such crowd drive components, however, has resulted in imposing a greater load on the gantry structure. It thus has been found to be desirable to provide a crowd drive assembly for a rope crowd system of a power shovel, mountable on the upper end of a gantry which will reduce the load imposed on the gantry structure.

Accordingly, it is the principal object of the present invention to provide an improved rope crowd system for a power shovel.

Another object of the present invention is to provide an improved crowd drive assembly for a rope crowd system of a power shovel.

A further object of the present invention is to provide an improved crowd drive assembly for a rope crowd system of a power shovel, mountable on an upper end of a gantry of a power shovel.

A still further object of the present invention is to provide a crowd drive system of a power shovel mountable on the upper end of a gantry structure which will impose a minimal load on the gantry structure.

Another object of the present invention is to provide a crowd drive assembly for a rope crowd system of a power shovel, mountable on the upper end of a gantry structure which will function in a manner whereby moments developed during normal operation can be absorbed in the gantry head structure.

A further object of the present invention is to provide a novel crowd drive assembly of a rope crowd system for a power shovel, mountable on the upper end of a gantry, providing a lower overall inertia, resulting in a more responsive machine.

A still further object of the present invention is to provide a novel crowd drive unit of a rope crowd system for a power shovel, mountable on the upper end of a gantry structure.

A still further object of the present invention is to provide a novel crowd drive assembly for a rope crowd system of a power shovel, mountable on the upper end of a gantry, which is comparatively simple in design, relatively inexpensive to manufacture and service, and easily accessible for servicing.

Other objects and advantages of the present invention will become more apparent to those persons having ordinary skill in the art to which the present invention pertains, from the following description taken in conjunction with the accompanying drawings, wherein.

Figure 1:
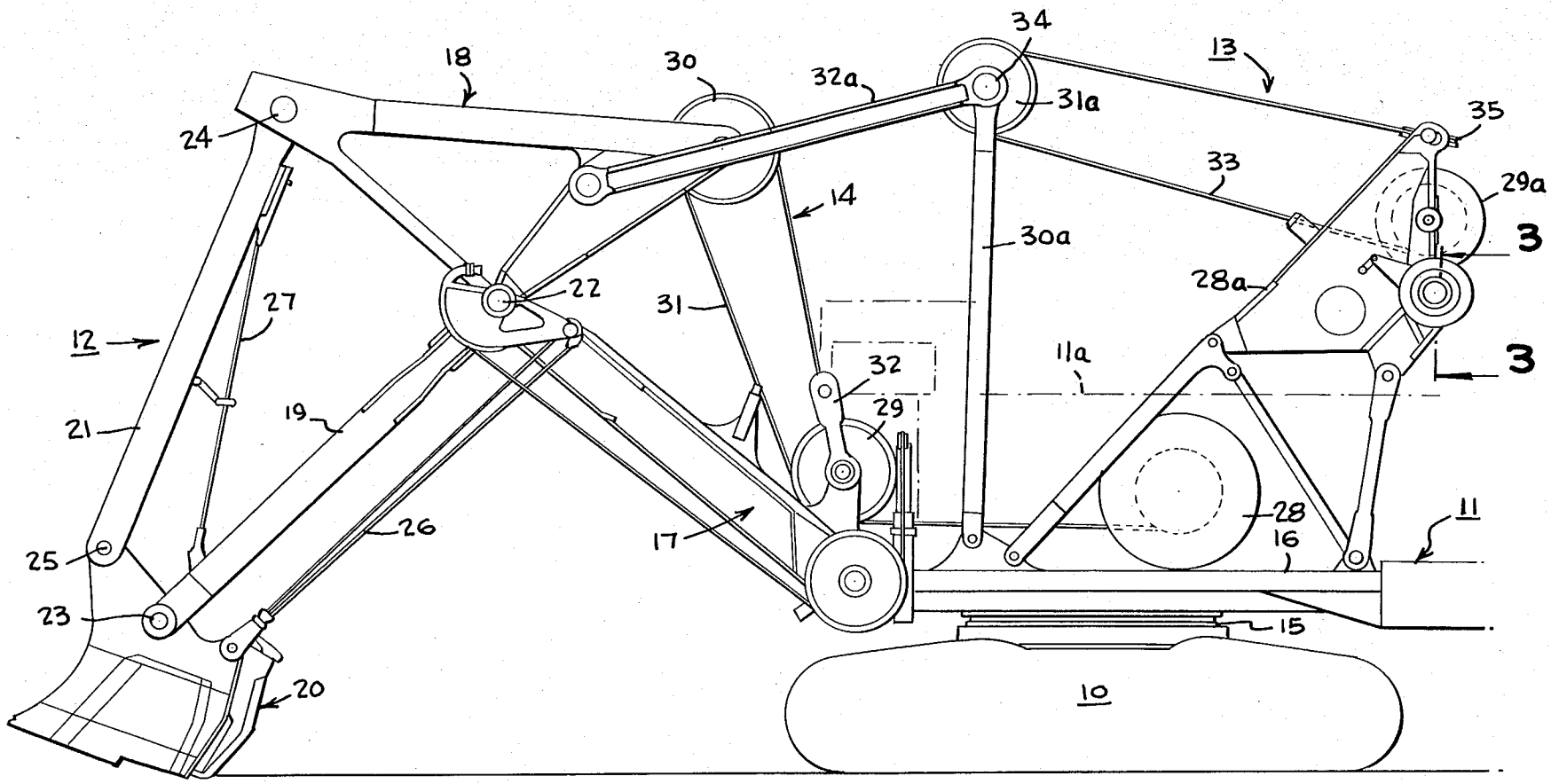
FIG. 1 is a side elevational view of a power shovel utilizing the present invention.

Referring to the FIG. 1 of the drawings, there is illustrated a power shovel utilizing an embodiment of the present invention which generally includes a crawler unit 10, a main support unit 11 mounted on the crawler unit, a front end assembly 12 mounted on the front end of the main support unit, a crowd system 13 mounted on the main support unit and operatively connected to the front end assembly, a hoist system 14 mounted on the front end assembly, and appropriate controls mounted on the main support unit for operating the crowd and hoist systems.

Crawler unit 10 consists of a lower frame supported on a pair of conventional crawler assemblies, and a conventional roller circle 15 mounted on the lower frame. Main support unit 11 consists of an upper frame 16 rotatably mounted on the roller circle and a housing 11*a* mounted on the upper frame, which encloses certain components of the housing structure, the swing and propulsion machinery and other auxiliary systems and equipment.

Front end assembly 14 generally includes a stiffleg 17, a hoist frame 18, a dipper handle 19, a dipper 20 and a hoist link 21. Stiffleg 17 consists of a structural member pivotally connected at its lower end to the front end of upper frame 16 and is provided at its upper end with a head shaft 22. Hoist frame 18 is pivotally mounted on head shaft 22. Handle 19 consists of a suitable structural member and is provided with upper and lower bifurcated ends. The upper bifurcated end is connected to the hoist frame by means of a pair of connecting pins. The lower bifurcated end of the stiffleg is pivotally connected to the upper rear end of dipper 20 by means of a pair of axially aligned pins 23. The forwardly disposed head section of the hoist frame and the upper front end of dipper 20 are connected by hoist link 21. The upper end of the hoist link is bifurcated and connected to the head section of the hoist frame by means of a connecting pin 24. The lower bifurcated end of the hoist link is connected to the dipper by means of a pair of axially aligned pins 25. It thus will be seen that hoist frame 18, handle 19, dipper 20 and hoist link 21 are pivotally connected together to provide a four-bar linkage with the link comprising the hoist frame being pivotally connected to the upper end of the stiffleg by means of head shaft 22.

To provide a substantially flat pass of the dipper when it is crowded into a bank of material being excavated or loaded, there is provided on the front end assembly a pitch control system 26, the construction and operation of which is fully described in U.S. Pat. Nos. 3,501,034 and 3,648,863. In addition, the front end assembly is provided with a pitch stop assembly 27, the construction and operation of which is fully described in U.S. Pat. No. 4,085,854.

Hoist system 14 generally includes a hoist drum 28, sheaves 29 and 30 and a hoist line 31. Hoist drum 28 is mounted on upper frame 16 of the machine and is driven by motor-generator sets through a gear train also mounted on the upper frame. Sheave 29 is mounted on the lower end of stiffleg 17 in longitudinal alignment with hoist drum 28. Sheave 30 is mounted on an upper, rearward end of hoist frame 18. As illustrated in FIG. 1, hoist line 31 is wound on hoist drum 28, extends forwardly and around sheave 29, extends upwardly and around sheave 30 and extends downwardly and is connected to a bail 32 mounted on the mounting shaft of sheave 29. It further will be seen that by operating hoist drum 28 to pay out or take in hoist line 31, hoist frame 18, handle 19 and hoist link 21 will be caused to pivot about head shaft 22 to correspondingly hoist and lower the dipper.

Crowd system 13 consists of a gantry **28*a* mounted on upper frame 16 of the machine, a crowd drive assembly 29*a* mounted on the upper end of the gantry above housing structure 11*a*, a mast 30*a* provided with sheaves 31*a*, a crowd link 32*a* and a crowd rope 33. Mast 30*a* consists of a structural member pivotally connected at its lower end to a bracket secured to the upper frame 16, forwardly of the vertical center line of roller circle 15. The upper end of mast 30*a* is provided with a shaft 34 on which sheaves 31*a* are mounted. Crowd link 32*a* is pivotally connected at the ends thereof to hoist frame 18 and mounting shaft 34 at the upper end of mast 30*a* so that pivotal motion of mast 30*a* in a vertical plane will be transmitted by crowd link 32*a* to the front end assembly of the machine. Crowd rope 33 is operatively connected to crowd drive assembly 29*a* and extends forwardly and around sheaves 31*a*, and rearwardly where it is connected to a bail 35 mounted on the head portion of gantry 28*a***.

Figure 2:
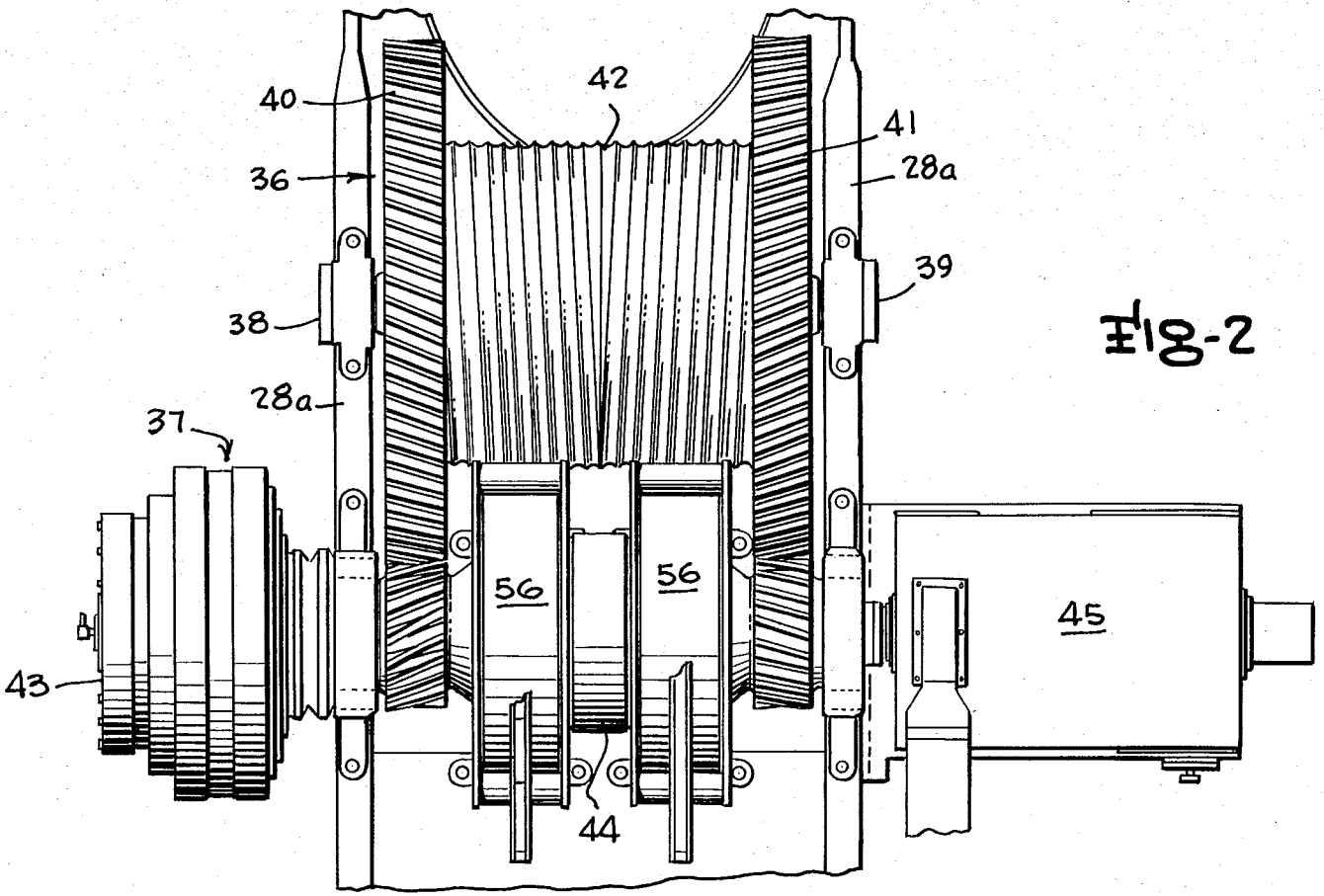
FIG. 2 is a rear elevational view of an embodiment of the invention.
Figure 3:
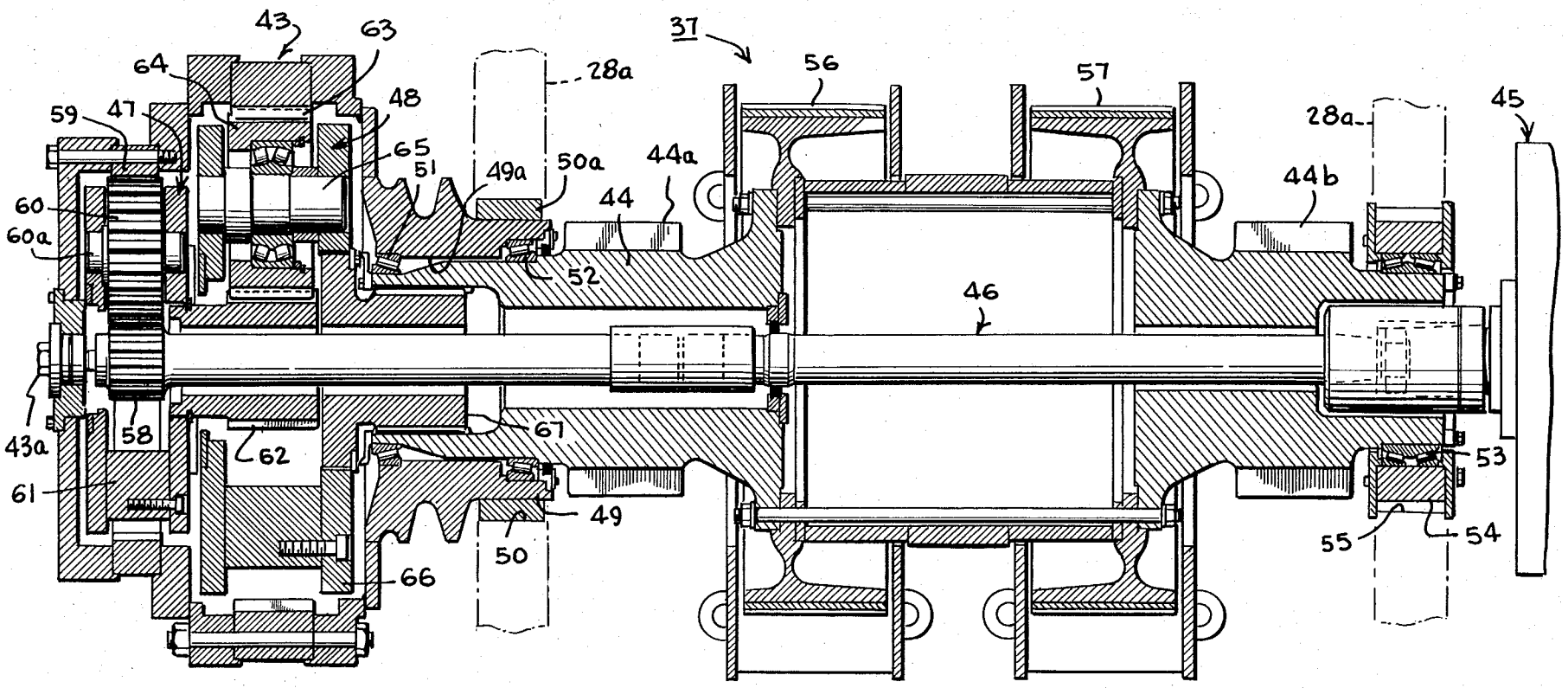
FIG. 3 is an enlarged cross-sectional view taken along line 3—3 in FIG. 1.

Referring to FIGS. 2 and 3, crowd drive assembly **29*a* consists of a rope drum 36 and a drive unit 37. The rope drum is trunnion mounted in a set of bearings 38 and 39 mounted in the upper, rear end of gantry 28*a*. It is provided with a pair of transversely spaced gears 40 and 41 and an intermediate drum portion 42 provided with suitable guide grooves for winding crowd rope 33 thereon. Drum portion 42 is disposed substantially in longitudinal alignment with mast 30*a* and mast sheaves 31*a***.

Drive unit 37 generally consists of a gear case 43, a pinion shaft 44, a motor 45, a drive shaft 46 and planetary gear sets 47 and 48. Gear case 43 is formed with an annular portion 49 which is received within an opening 50 in gantry **28*a*, provided with solid bearings 50*a***, for mounting the gear case on one side of the gantry.

The axial opening in annular portion 49 is provided with a pair of bearings 51 and 52 for supporting one end of pinion shaft 44. Aligned axially with bearings 51 and 52 is a bearing 53 mounted in a bearing block 54 provided in an opening in gantry **28*a***, for supporting the other end of the pinion shaft.

Pinion shaft 44 is provided with an axially disposed passageway and a pair of integrally formed helical pinions **44*a* and 44*b* which are adapted to mesh with helical bull gears 40 and 41 of crowd drum 36 when the drum is trunnion mounted in bearings 38 and 39 and pinion shaft 44 is journaled in bearings 51, 52 and 53. The pinion shaft also is provided with a pair of brake drums 56 and 57** which are adapted to be frictionally engaged by brake bands to arrest the rotation of the pinion shaft.

Motor 45 may consist of either an electrical or a hydraulic motor and is rigidly mounted on gantry **28*a* on a side opposite from gear case 43. Drive shaft 46 is drivingly connected to the output shaft of motor 45 and extends through the entire length of the axial opening in the pinion shaft, into gear case 43. The free end of shaft 46 is journaled in a bearing 43*a* mounted on the end wall of gear case 43**.

Planetary gear set 47 consists of a sun gear 58, a ring gear 59 and a plurality of planetary gears 60. Sun gear 58 is formed integrally with the end of drive shaft 46. Ring gear 60 is formed as an outer wall section of gear case 43. Each of planetary gears 60 is provided with a shaft **60*a* mounted in a planetary gear carrier 61**.

Planetary gear set 48 consists of a sun gear 62, a ring gear 63 and a plurality of planetary gears 64. Sun gear 62 is provided with an axial opening receiving drive shaft 46 therethrough, and is drivingly connected to planetary gear carrier 61 of gear set 47. Ring gear 63 is formed as a component of gear case 43. Each of planetary gears 64 is provided with a shaft 65 mounted in an annular carrier 66. Planetary gear carrier 66 is provided with an annular portion 67 which extends into an enlarged section of the opening in pinion shaft 44 and which receives drive shaft 46 therethrough. The outer end of annular carrier portion 67 is provided with external splines which engage a set of internal splines on the end of the pinion shaft to drivingly connect the planetary gear carrier of gear set 48 to the pinion shaft.

As best seen in FIGS. 1 and 2, the pinion shaft is mounted on the gantry adjacent the tangent point of rope 33 wound on drum 36. Thus, the proximity of the pinion gears to the tangent point of the rope will provide a resultant component of force which will function to counteract the force exerted on the drum by the rope, thereby reducing the load imposed on the drum bearings. Furthermore, the mounting of the gear train and motor at opposite ends of the pinion shaft, providing transversely spaced pinions for transmitting torque from the pinion shaft to the bull gears of the drum, and providing helical teeth on the pinion and bull gears of the assembly, further contribute to balancing the static and dynamic loads imposed on the drum bearings.

In the operation of the drive unit as described, whenever motor 45 is operated, drive will be transmitted through drive shaft 46, through planetary gear set 47, planetary gear set 48 and pinion shaft 44 to drum 36. Under such circumstances, the drive will be subjected to a first stage speed reduction by planetary gear set 47, a second stage speed reduction by planetary gear set 48 and a third stage reduction by the pinion gears and the gears on the rope drum. Whenever it is desired to brake the unit, a suitable mechanism is operated to cause the brake bands cooperating with brake drums 56 and 57 to frictionally engage such drums to arrest the rotation of the pinion shaft. The rotation of gear case 43 can be restrained by any suitable means including a link, such as a torque arm operatively interconnecting the gear case and the gantry.

At the beginning of each digging cycle of the machine as described, the crowd system is operated to fully retract the front end assembly and the hoist system is operated to lower the dipper so that the dipper is positioned adjacent the lower end of the stiffleg. Suitable resilient pads are provided at the lower end of the stiffleg to prevent damage to the stiffleg by the dipper. To commence the operating cycle of the machine, the operator manipulates appropriate controls at the operator's station on the machine to permit the crowd rope to pay out. Under such conditions, the weight of the front end assembly will cause the stiffleg to pivot forwardly, simultaneously crowding the dipper into the material being excavated or loaded. Simultaneously with the commencement of the crowding action of the dipper, appropriate controls are operated on the machine to effect limited hoisting motion of the dipper. This is accomplished by operating hoist drum 28 to take up hoist line 31. As the dipper is crowded into the bank of material being excavated or loaded, the combined crowding and hoisting action causes it to make a flat pass. At the same time, pitch control system 26 causes the pitch of the dipper to remain constant relative to the ground. At the end of the crowd phase of the cycle, the pitch control mechanism is released to cause the dipper to pitch upwardly and thus assure a full load of material in the dipper. The upward pitch of the dipper is restricted by pitch stop system 27 in a manner as described in the aforementioned patent relating to such system.

After the dipper has been pitched upwardly, controls for the crowd and hoist systems and swing machinery are operated to position the dipper above the dump body of a hauling vehicle or another suitable repository for the material, where the door of the dipper is tripped to cause the door to open and the material to be unloaded. The desired retracting motion of the front end assembly is effected by operating crowd motor 45 to rotate crowd drum 36 and take in crowd rope 33. Under such conditions, mast 30*a* will be caused to pivot rearwardly and such motion will be transmitted to the front end assembly 12 causing the stiffleg 17 to pivot upwardly.

As soon as the material has been dumped, the swing machinery can be operated to rotate the front end of the machine back to the embankment, the crowd system can be operated to continue to retract the front end assembly and the hoist system can be operated to permit the dipper handle to swing downwardly at a controlled rate until it again is positioned at the lower end of the stiffleg, ready to begin another operating cycle.

The invention as described provides a number of advantages over comparable crowd drive assemblies of the prior art. It eliminates the necessity of extending ropes down from the head of the gantry to the deck of the machine and providing additional sheaves for crowd operation. Because of the minimal weight and size of the crowd drive components mounted on the gantry head, it reduces the amount of gantry structure required. Mounting of all of the transmission components is simplified. All such components are shaft mounted with the exception of some motor frames which require foot mountings. The manufacturing costs of the entire crowd system are reduced substantially. Applied torque and reaction torque are applied concentrically. As a result of a lower overall inertia of the system, a more responsive machine results. The reduced size of gearing components simplifies the manufacture of the machine and makes spare parts more economical. The engagement of the pinions in an area adjacent to the rope tangent on the drum, and the mounting of both the drum and the pinion shaft on the rear side of the gantry have allowed the use of simple, relatively light bearing caps, since the applied loads do not tend to pull the bearings away from the gantry. Furthermore, the reduced size of the gearing components allows shipment of the components as assembled units and thus eliminates the requirement for field adjustments to effect proper gear alignment.

From the foregoing detailed description, it will be evident that there are a number of changes, adaptations and modifications of the present invention which fall within the province of those persons having ordinary skill in the art to which the present invention pertains. However, it is intended that all such variations not departing from the spirit of the invention be considered as within the scope thereof as limited solely by the appended claims.

I claim:

1. In a power shovel having a main support unit, a front end assembly operatively connected to said main support unit and a rope crowd system mounted on said main support unit and operatively connected to said front end assembly, a crowd drive assembly for said rope crowd system comprising a rope drum mounted on a support frame supported on said main support unit, a pinion drive shaft journaled in said support frame adjacent the tangential point of said crowd rope wound on said drum, transversely spaced means disposed on said pinion drive shaft for simultaneously transmitting torque to said rope drum and means supported on said main support unit for driving said pinion drive shaft.

2. A crowd drive system according to claim 1 wherein said drum is mounted at an upper head portion of said support frame.

3. A crowd drive assembly according to claim 2 wherein said drum and pinion drive shaft are mounted at a rearward end of said support frame.

4. A crowd drive assembly according to claim 1 wherein said means for transmitting torque from said pinion drive shaft to said rope drum comprises a pair of pinions mounted on said pinion drive shaft drivingly engaged with a pair of bull gears mounted on said rope drum.

5. A crowd drive assembly according to claim 4 wherein said pinions and bull gears are helical gears.

6. A crowd drive assembly according to claim 1 including a gear train set drivingly interconnecting said drive means and said pinion drive shaft.

7. A crowd drive assembly according to claim 6 wherein said gear train set comprises a planetary gear set.

8. A crowd drive assembly according to claim 7 wherein said gear train set includes a sun gear, a ring gear and a plurality of planetary gears mounted on a rotatable carrier, one of said gear set components being drivingly connected to said drive means and another of said gear set components being drivingly connected to said rope drum and including means for restraining the rotation of a further one of said gear set components.

9. A crowd drive assembly according to claim 8 wherein said planetary gear carrier is drivingly connected to said rope drum.

10. A crowd drive assembly according to claim 8 wherein said sun gear is drivingly connected to said drive means.

11. A crowd drive assembly according to claim 8 wherein said ring gear is mounted on a casing linked to said support frame by means of a torque arm.

12. A crowd drive assembly according to claim 7 including a second planetary gear set operatively connected in series with said first mentioned planetary gear set providing first and second gear reduction stages.

13. A crowd drive assembly according to claim 6 wherein said gear train set is mounted on said support frame at one end of said pinion drive shaft and said drive means is mounted on said support frame at an opposite end of said pinion drive shaft.

14. A crowd drive assembly according to claim 6 wherein said means for transmitting torque from said pinion drive shaft to said rope drum comprises a pair of helical pinions mounted on said pinion drive shaft meshing with a pair of helical bull gears mounted on said rope drum.

15. A crowd drive assembly according to claim 1 including means for braking said pinion drive shaft.

16. A crowd drive assembly according to claim 1 wherein said crowd drum is under-wound in said rope drum.

17. In a power shovel having a support unit, a front end assembly including a working implement, operatively connected to said support unit and a rope crowd system mounted on said support unit and operatively connected to said front end assembly, a crowd drive assembly comprising a support frame mounted on said support unit, a rope drum rotatably mounted on said support frame, and a drive unit comprising a gear case mounted on said support frame, a pinion shaft journaled in said gear case and said support frame, said shaft having a pair of pinions formed integrally therewith drivingly engaged with gears provided on said rope drum, adjacent a tangential point of a crowd rope wound on said rope drum, a motor having a drive shaft mounted on said support unit and a planetary gear set disposed in said gear case, said gear set including a sun gear mounted on said motor shaft, a ring gear mounted on said gear case and a plurality of planetary gears mounted on a rotatable carrier operatively connected to said pinion shaft, and means for restraining the rotation of said gear case.

18. A crowd drive assembly according to claim 17 wherein said gear case and said motor are disposed at opposite ends of said pinion shaft and said motor drive shaft extends through an axially disposed opening in said pinion shaft.

19. A crowd drive assembly according to claim 17 including a second planetary gear set disposed in said gear case, said second gear set including a sun gear drivingly connected to the planetary gear carrier of said first gear set, a ring gear mounted on said gear case and a plurality of planetary gears mounted on a rotatable carrier drivingly connected to said pinion shaft.

20. A crowd drive assembly according to claim 19 wherein said gear case and motor are disposed at opposite ends of said pinion shaft and said motor drive shaft extends through an axially disposed opening in said pinion shaft.

21. A crowd drive assembly according to claim 17 including at least one brake drum mounted on said pinion shaft.

22. A crowd drive assembly according to claim 17 wherein said means for restraining the rotation of said gear case comprises a torque arm operatively interconnecting said support frame and said gear case.

* * * * *